US005611465A

United States Patent [19]

Lee et al.

[11] Patent Number: 5,611,465

[45] Date of Patent: Mar. 18, 1997

[54] AUTOMATIC TOILET BOWL CLEANER

[76] Inventors: Kuo-Chou Lee, No. 93, Shang-Jen Street, Noan Noan, Keelung City; Tsang-Chang Hwang, 3F, No. 30, Alley 31, Lane 49, Sec. 4, Chung King N. Rd.; Aling Shu, No. 5, Lane 157, Yen Ping South Rd., both of Taipei, all of Taiwan

[21] Appl. No.: 407,362

[22] Filed: Mar. 20, 1995

[51] Int. Cl.[6] ..... B65D 37/00

[52] U.S. Cl. ..... 222/214; 222/638; 4/226.1

[58] Field of Search ..... 222/214, 638, 222/651, 646; 4/226.1, 224, 223

[56] References Cited

U.S. PATENT DOCUMENTS

| | | | |
|---|---|---|---|
| 3,060,456 | 10/1962 | Jacobs | 4/226.1 |
| 5,449,117 | 9/1995 | Muderlak et al. | 222/646 X |
| 5,492,247 | 2/1996 | Shu et al. | 222/214 X |

FOREIGN PATENT DOCUMENTS

| | | | |
|---|---|---|---|
| 579581 | 1/1994 | European Pat. Off. | 4/226.1 |
| 6136804 | 5/1994 | Japan | 4/226.1 |

*Primary Examiner*—Gregory L. Huson
*Attorney, Agent, or Firm*—Bacon & Thomas

[57] ABSTRACT

A toilet bowl is automatically cleaned by a device having an automatic liquid soap dispenser and a guided flow tube. The dispenser is provided with a timer-activated device, and the guided flow tube is connected to the water supply connection of the toilet bowl. The liquid soap is squeezed through the guided flow tube into the water supply connection, thereby allowing the water to be mixed with the liquid soap for flushing and cleaning the toilet bowl.

2 Claims, 6 Drawing Sheets

A–A

B–B

AUTOMATIC TOILET BOWL CLEANER

BACKGROUND OF THE INVENTION

1. Field of the Invention

The present invention relates to the structure and design of a timer-controlled automatic soap dispenser for toilet bowl, more specifically, the present invention provides a structure in which the liquid cleaning soap can be squeezed out and mixed with water automatically for cleaning and disinfecting a toilet bowl.

2. Description of the Prior Art

Toilet bowls are generally connected to water supply connections, and flushing a toilet bowl can be accomplished automatically or by pressing a handle. However, the stain and the bad odor of a toilet bowl cannot be eliminated by flushing with clean water. The effect from flushing with clean water is usually not remarkable.

SUMMARY OF THE INVENTION

The main object according to the present invention is to provide a structure of a timer-controlled, automatic soap dispenser for toilet bowl. The structure consists of an automatic soap dispenser and a guided flow tube. The automatic soap dispenser is provided with a timer-activated device, in which the timer is activated at a preset time so that the liquid soap can be squeezed out by a pressed member. The liquid soap flows through the guided flow tube and into the water supply connection of the toilet bowl. Cleaning and disinfecting results can be obtained during flushing. It is convenient to use the structure.

Another object according to the present invention is to provide a structure of a timer-controlled automatic soap dispenser for toilet bowl in which the operation of the structure is not affected by the water pressure. In addition, since the liquid soap is dispensed at a fixed amount and controlled by a timer, the cleaning liquid provided to each floor of a building will be the same. Therefore, it is convenient for the management personnel to use the device in a multi-story building. The device saves time and effort and is very suitable to be used in a high-rise building.

BRIEF DESCRIPTION OF THE DRAWINGS

The invention will be more fully understood from the following detailed description thereof, taken in conjunction with the accompanying drawings, in which.

DETAILED DESCRIPTION OF THE PREFERRED EMBODIMENT

Figure 1:
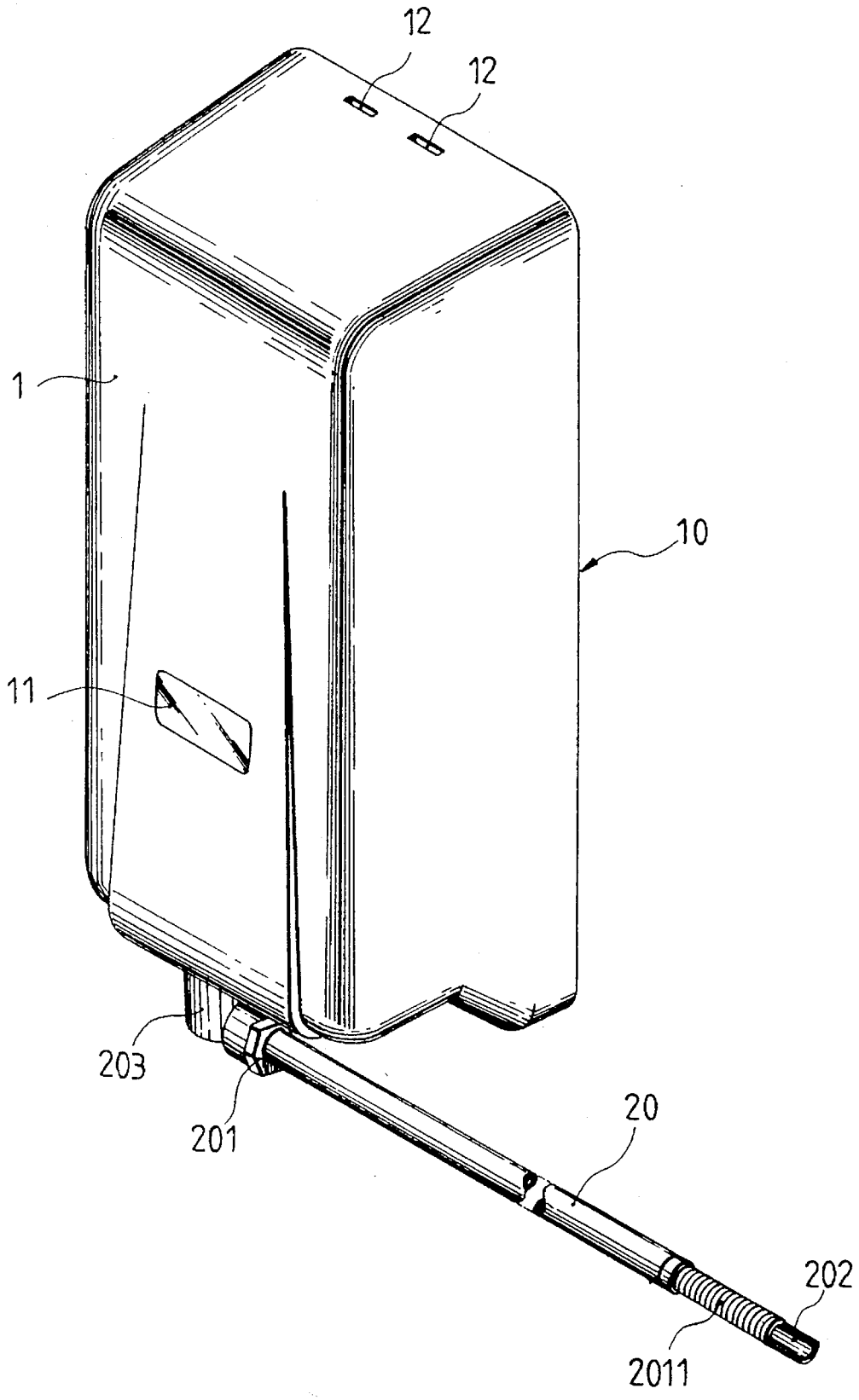
FIG. 1 is a perspective view of the assembly according to the present invention.
Figure 2:
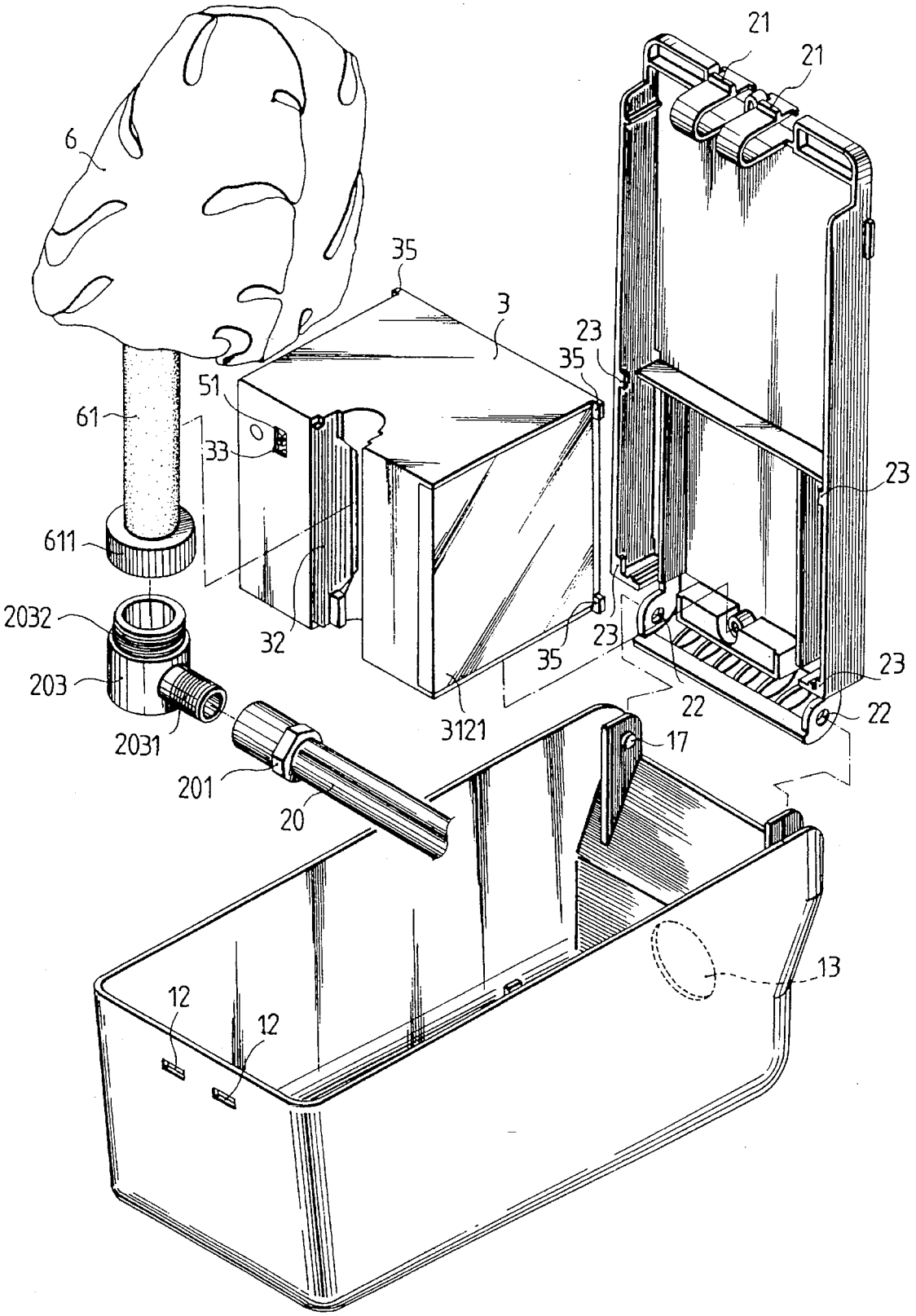
FIG. 2 is a perspective fragmented view of the present invention.

As shown in FIGS. 1 and 2, the present invention comprises an automatic soap dispenser 10 and a guided flow tube 20. The automatic soap dispenser consists of a housing 1, a base 2, a holding base 3, a driver device 4, a timer-activated device 5 and a soap storage bag 6.

The housing 1 is formed into an appropriate shape for enclosing the components of the soap dispenser. The front of housing 1 is provided with a viewing window 11, and the top of housing 1 is provided with two slots 12. The bottom surface of housing 1 is provided with a guided tube hole 13 and a sensing hole 14. The inner front wall of housing 1 is provided with a blocking plate 15 and a post 16.

The base 2 is a plate corresponding to the opening of housing 1, its top is provided with two latching plates 21 and the two sides of its bottom are respectively provided with a pivotal hole 22, which is used for the pivotal connection between housing 1 and base 2, thereby providing a movable coupling. Latching plates 21 are used as components for opening and closing. In addition, in a selected location of base 2 is provided with a plurality of insertion plates 23 for the insertion and positioning of holding base 3.

Figure 3:
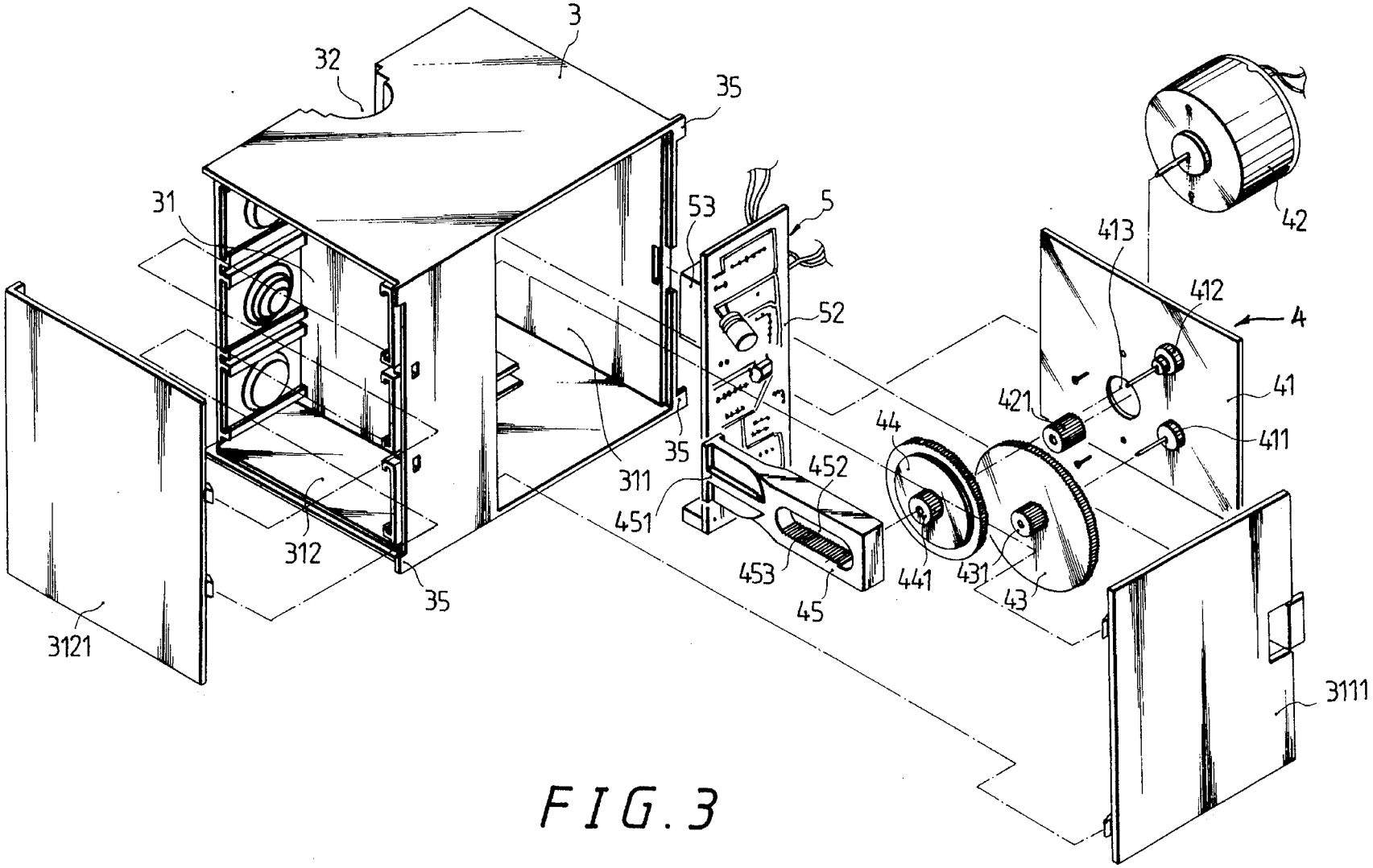
FIG. 3 is a perspective fragmented view of the automatic soap dispenser according to the present invention.
Figure 4:
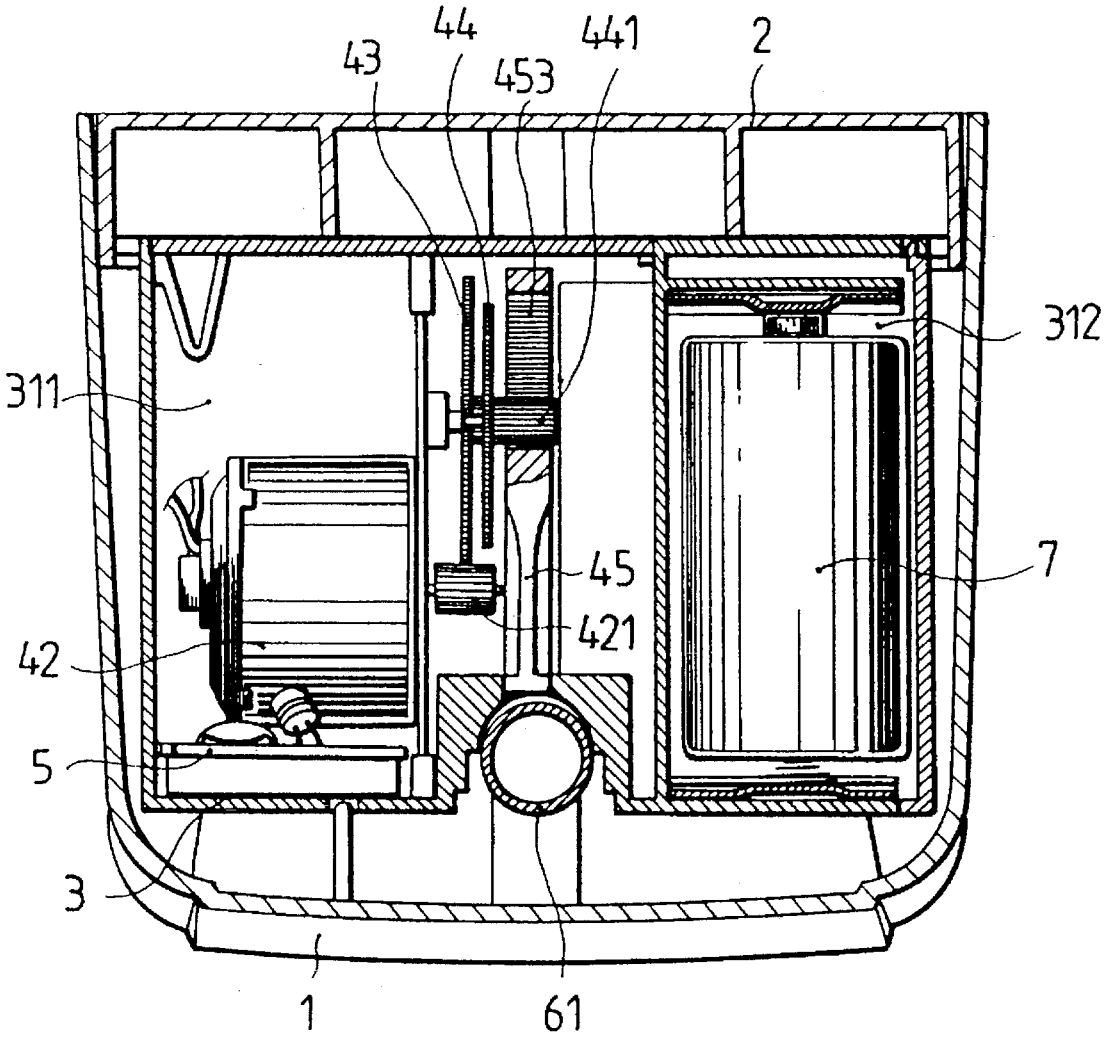
FIG. 4 is a cross-sectional view of the automatic soap dispenser according to the present invention.

The holding base 3, as is shown in FIGS. 3 and 4, is formed into the shape of a housing, its interior is provided with a divider wall 31, which divides the holding base 3 into two internal chambers 311 and 312. Internal chamber 311 is provided for the storage of driver device 4 and the timer-activated device 5. A cover 3111 is provided for sealing of its opening. Internal chamber 312 is provided for the storage of a battery pack 7, and a cover 3121 is also provided for sealing of its opening. The central portion at the front of holding base 3 is formed into a concave guided tube channel 32. The surface of the guided tube channel 32 is provided with a hole 321. One edge at the front surface of holding base 3 is provided with a hole 33.

The driver device 4 consists of a panel 41, which is provided with supporting shafts 411 and 412 and a hole 413 for securing the gearing and motor 42 in place. The driver device 4 uses motor 42 to drive a small gear 421 on the same shaft, a large gear 43 can then be driven. A small gear 431 on the same shaft of the large gear 43 is then used to transmit power to another large gar 44. Another small gear 441 on the same shaft of large gear 44 is used to drive an elongated toothed piece 45. The forward portion of toothed piece 45 is provided with a presser member 451, and the center portion is provided with an elongated hole 452. The wall on the bottom of elongated hole 452 is formed into a toothed section 453, the teeth of which mesh with the teeth of small gear 441. The forward section of toothed piece 45 is the hole 321 extended from the guided tube channel 32 of holding base 3, thus its front surface can be used to press the soap feeding tube 61 of the soap storage bag 6.

The timer-activated device 5 is provided inside the chamber 311 of holding base 3. A safety switch 51 is installed corresponding to the hole 33 provided on the holding base 3, and a timer 53 provided on the circuit board 52 made up the circuit. By use of an adjustment knob (not shown), the timer can be set to activate for a duration (such as 5, 10, 15, 20, 30 or 60 minutes). Thus when the timer activates the driver device 4, the motor 42 can be used to carry out the squeezing task. The timer-activated device 5 may also be provided with a selector switch for selecting a 24-hour or AM-PM operation. A light sensing device is used to sense the light for timer operation, if the illumination of the light is below a certain level, then the timer will automatically be stopped.

The soap storage bag 6 is provided on the top of the holding base 3 and is used to hold liquid soap or cleaner, one end of bag 6 is connected to a soap feeding tube 61, which is a flexible tube and is placed inside the guided tube channel 32 of the holding base 3.

By the above configuration, housing 1 can be pivotally connected thorough the pivotal holes 17 of the base 2, allowing housing 1 to be movably coupled. The latching plates 21 provided in the base 2 are used to retain and secure on the slots 12 of the housing 1, and the latching plates 21 are used for opening and closing. The holding base 3 utilized the lugs 35 provided on both sides of it so that it can be assembled and positioned on the insertion plates 23 provided on the base 2. The driver device 4 and the timer-activated device 5 are contained inside chamber 311 of the holding base 3. The soap storage bag 6 is placed on the top surface of the holding base 3, and the soap feeding tube 61 is placed inside the guided tube channel 32 of the holding base 3. When the housing 1 is put together with the base 2, the post 16 provided in the inner wall of housing 1 cooperates with hole 33 of the holding base 3 so as to press against the safety switch 51 of the timer-activated device 5 so that the automatic soap dispenser is activated. On the other hand, if the housing is opened, then the post 16 is no longer in contact with the safety switch 51, therefore, the automatic soap dispenser is deactivated. When housing 1 and base 2 are put together in a closed position, the blocking plate 15 in the inner wall of housing 1 is holding the outer surface of the soap feeding tube 61 of the soap storage bag 6, and the bottom of the soap feeding tube 61 is exposed outside the guided tube hole 13 of the housing 1.

The operation of the automatic soap dispenser can be described as follows: when the time is up and the timer-activate device 5 of the automatic soap dispenser detects the time signal, the motor 42 is triggered to start. Power is transmitted through the small gear 421, the transmission large gear 43, another small gear 431, large gear 44 so as to drive the small gear 441 into operation. Since the teeth of the small gear 441 mesh, or mate with the teeth 453 of the elongated toothed piece 45, therefore, the toothed piece 45 can be driven at a higher torque, allowing the toothed piece 45 to move forward in a straight line direction. Normally, the forward section of the tooth piece 45 is extended through the hole 321 of the guided tube channel 32 of the holding base 3, also, the pressed member 451 of the tooth piece 45 is urging the outer surface of the soap feeding tube 61, and the outer surface of the feeding tube 61 is supported by the blocking plate 15 of the housing 1. Therefore, when the tooth piece 45 is driven to move in a straightforward direction, the presser member 451 provided at one end of the tooth piece presses onto the soap feeding tube 61, squeezing the liquid soap therein. When the tooth piece 45 has pressed for an appropriate preset duration of time, the driver device stops operation. At this time an appropriate amount of liquid soap has been squeezed out and the operation of dispensing is thus completed. Since the soap feeding tube 61 is relatively flexible, therefore, the flexible tube 61 pushes, by resiliency, the tooth piece 45 back to the original position to get ready for the next operation.

In addition, the guided flow tube 20 is a circular tube, one end of it is provided with a nut 2022, the other end of it is provided with a slit 22 for cooperating with an L-shaped coupling 203. The two ends of the L-shaped coupling 23 are provided with appropriate threaded ends 2031 and 2032. The threaded end 2032 can be attached to the soap feeding tube 61 through a coupling nut 611; the other threaded end 2031 can be connected to a connector 201 at one end of the guided flow tube 20. Thus the soap feeding tube 61 and the guided flow tube 20 are connected together. Washers can be placed inside the nut 21 and the coupling nut 611 to prevent leaking, these washers can be provided in a conventional method, therefore, it is not being described here. In addition, one end of the guided flow tube 20 is provided with external threads 2011, which may be connected to the water supply connection 30 through a coupling nut 2022, allowing its slit 22 in the axial direction to face the water flow. This helps the water flow to enter into the guided flow tube 20 and the liquid soap can be pushed out with the flow of water.

Figure 6:
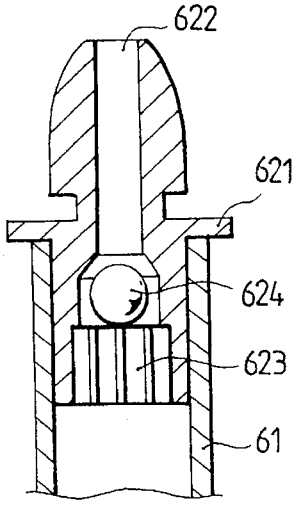
FIG. 6 is a cross-sectional view of the one-way ball valve provided on the top of the soap feeding tube of the automatic soap dispenser according to the present invention.
Figure 7:
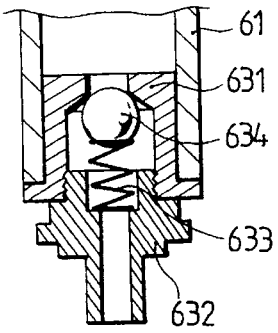
FIG. 7 is a cross-sectional view of the one-way ball valve provided on the bottom of the soap feeding tube of the automatic soap dispenser according to the present invention.
Figure 8:
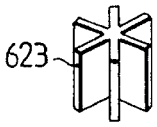
FIG. 8 is a perspective view of the plate member provided inside the soap feeding tube of the automatic soap dispenser according to the present invention.
Figure 5:
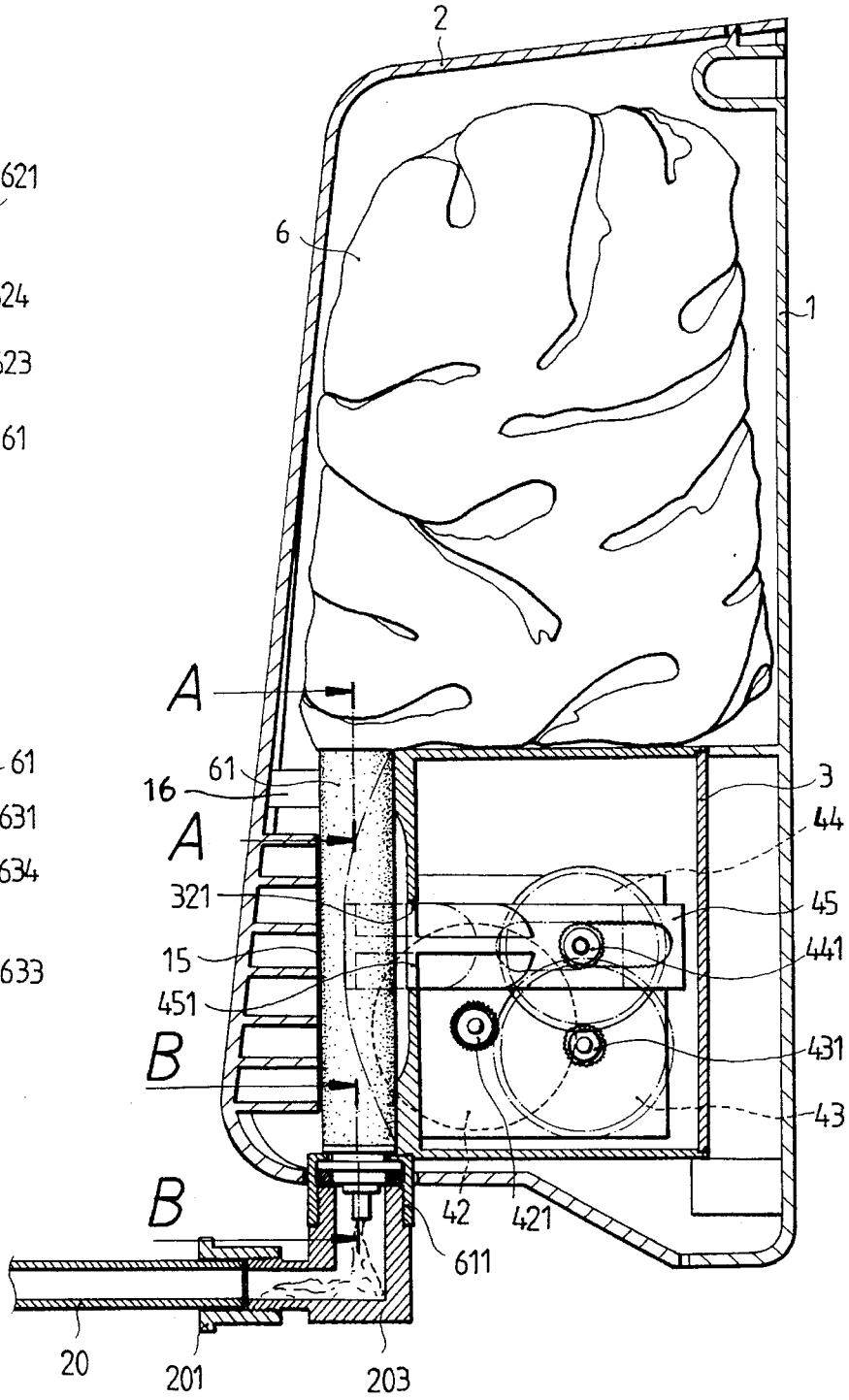
FIG. 5 is a vertical sectional view of the automatic soap dispenser according to the present invention.
Figure 9:
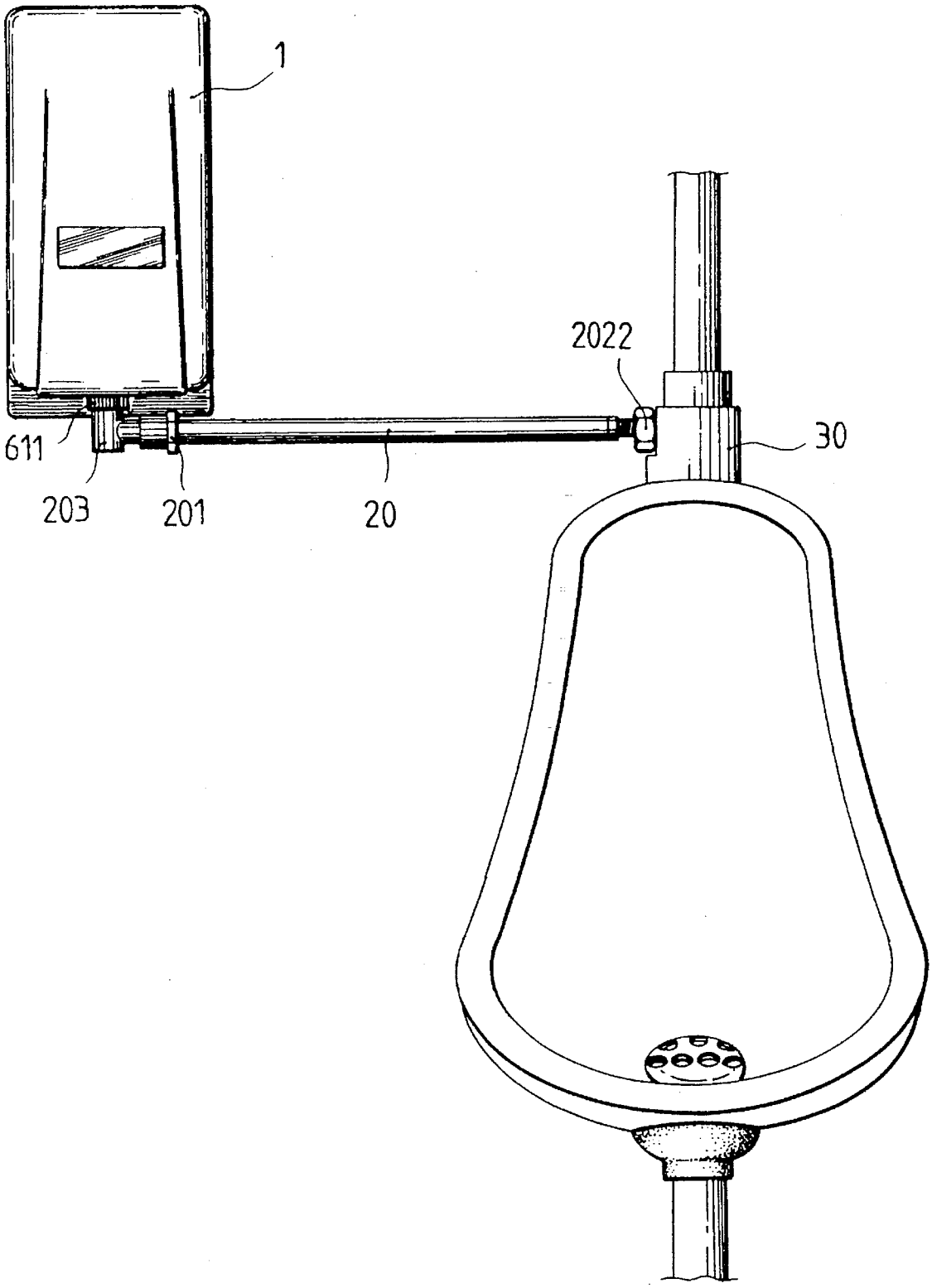
FIG. 9 is a completed embodiment of the present invention.

The two ends of the soap feeding tube 61 are provided with one-way ball valves 624 and 636 respectively, as is shown in FIGS. 6 and 7. The top portion of the soap feeding tube 61 is provided with a valve body 621, and an appropriate conical hole 622 is provided within the valve body 621. The inside of the conical hole 622 is provided with a plate member 623, which is used to hold a ball valve 624. Normally the conical hole 622 is open, when the liquid soap is trying to flow in the reverse direction, the ball valve 624 pushed up against the conical hole 622 so that the latter is close, preventing the liquid soap to flow in the reverse direction. In addition, the lower part of the soap feeding tube 61 is also provided with a valve body 631, which is integrated with a discharge nozzle 632. Between the valve body 631 and the discharge nozzle 632 is a spring 633 to hold a ball valve 634, which is used to control the opening and closing of the conical hole 635. When the liquid soap flows out, the ball valve 634 is pushed downward, allowing the liquid to be discharged from nozzle 632; however, the spring 633 normally holds the ball valve 634 in place so that the conical hole is closed.

By configuring the above-mentioned automatic soap dispenser 10 and the guided flow tube 20 together, the motor 42 of the timer-activated device 4 can be initiated during a set interval, and each time the soap feeding tube 61 of the soap storage bag 6 is squeezed, the liquid soap can be squeezed out through the guided flow tube 20. The liquid soap enters into the water supply connection 30 of the toilet bowl, then the liquid soap is distributed. When the toilet bowl is flush with water, the soap can be mixed with the flushing water (or part of the water may enter from the slit 22 of the guided flow tube 20 and mix with the soap before flushing into the toilet bowl) so as to clean and disinfect the toilet bowl.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. An automatic toilet bowl cleaner comprising:

a) a soap dispenser including a base, a housing connected to the base for movement between open and dosed positions, a holding base mounted to the base and containing a driver means, a soap storage bag disposed within the housing and including a flexible feeding tube engageable by the driver means for dispensing soap therefrom;

b) a timer means disposed within the holding base for activating the driver means at predetermined intervals of time, the timer means including a timer, a circuit means and means for adjusting the predetermined time intervals for activating the driver means; and c) a guided flow tube having first and second ends, an L-shaped coupling connecting the first end of the flow tube to the flexible feeding tube for receiving soap therefrom and the second end for connection to a water supply line of a toilet bowl, whereby soap dispensed from the flexible feeding tube through the flow tube is mixed with the water from the water supply line to clean the toilet bowl.

2. The automatic toilet bowl cleaner of claim 1 wherein the L-shaped coupling includes two threaded ends, the flexible feeding tube and the first end of the flow tube each includes a threaded coupling disposed in threaded engagement with the threaded ends of the L-shaped coupling.

* * * * *